United States Patent [19]

Peterson et al.

[11] Patent Number: 4,827,713

[45] Date of Patent: May 9, 1989

[54] STATOR VALVE ASSEMBLY FOR A ROTARY MACHINE

[75] Inventors: Steven C. Peterson, Vernon, Conn.; Aaron Kaplan, Staten Island, N.Y.

[73] Assignee: United Technologies Corporation, Hartford, Conn.

[21] Appl. No.: 68,079

[22] Filed: Jun. 29, 1987

[51] Int. Cl.[4] ..... F02K 3/04

[52] U.S. Cl. ..... 60/226.1; 60/39.07; 415/150; 415/157; 74/107

[58] Field of Search ..... 60/226.1, 39.07, 262, 60/39.83, 39.29; 415/150, 157, 158, 144, 145; 74/99 A, 107

[56] References Cited

U.S. PATENT DOCUMENTS

| | | | |
|---|---|---|---|
| 3,030,006 | 4/1962 | Shoup, Jr. | 415/145 |
| 3,057,541 | 10/1962 | Hasbrouck et al. | 415/150 |
| 3,094,270 | 6/1963 | Kent et al. | 415/145 |
| 3,095,750 | 7/1963 | Mahn | 74/107 |
| 3,638,428 | 2/1972 | Shipley et al. | 60/226.1 |
| 3,847,034 | 11/1974 | Hemens | 74/107 |
| 3,898,799 | 8/1975 | Pollert et al. | 60/226.1 |
| 4,463,552 | 8/1984 | Monhardt et al. | 60/226.1 |
| 4,546,605 | 10/1985 | Mortimer et al. | 60/226.1 |
| 4,633,900 | 1/1987 | Suzuki | 74/107 |
| 4,715,779 | 12/1987 | Suciu | 60/226.1 |

*Primary Examiner*—Donald E. Stout

[57] ABSTRACT

A compressor bleed valve assembly 28 having an axially translatable valve ring 66 for a gas turbine engine 10 is disclosed. Various construction details which increase the sealing effectiveness of a valve ring 66 are developed. In one embodiment, the valve ring is adapted to engage a slot 56 as the valve ring is moved between the open to the closed position, the slot being contoured to provide a mechanical advantage as the valve ring moves to the closed position against resilient sealing members 58, 60 which axially engage the valve ring.

12 Claims, 3 Drawing Sheets

FIG. 2
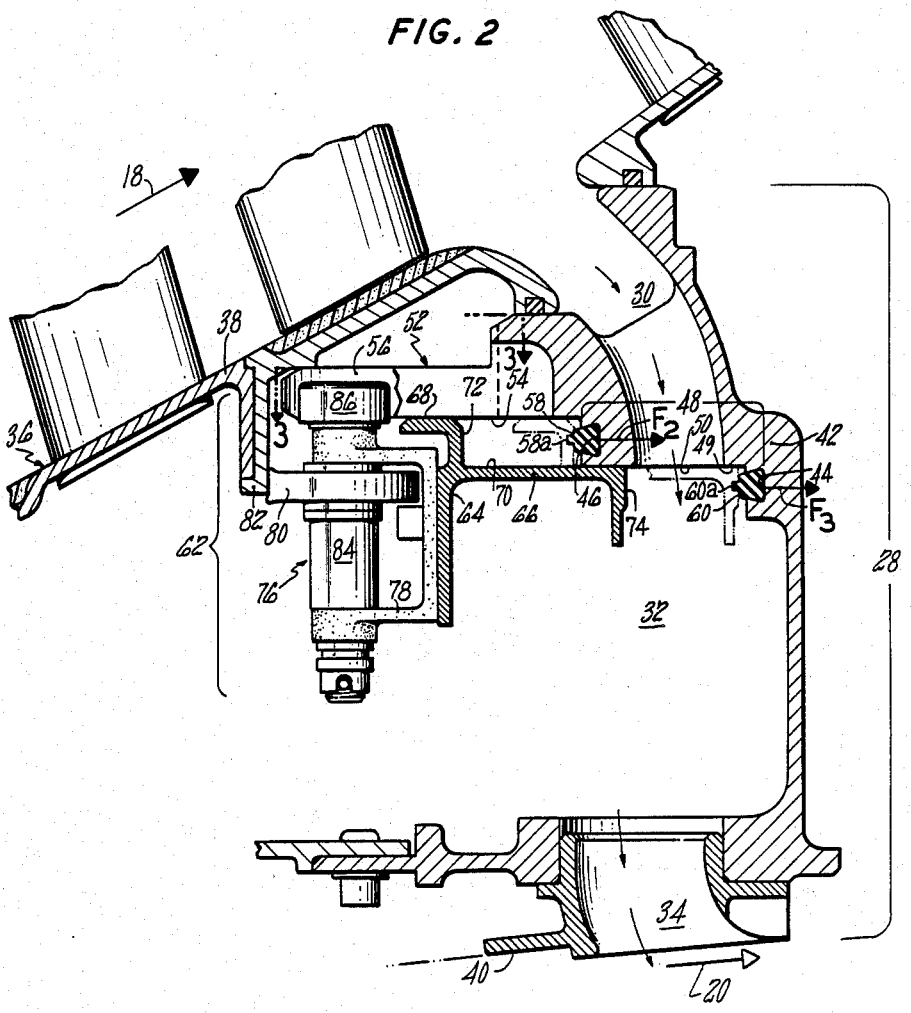
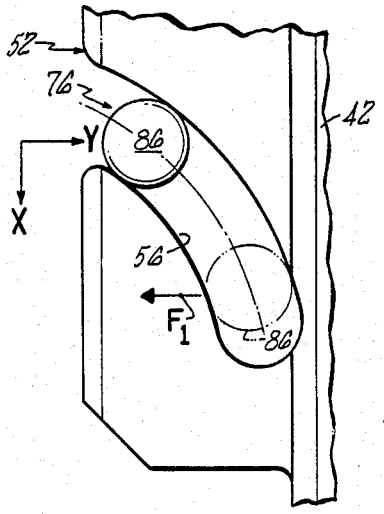
FIG. 3

STATOR VALVE ASSEMBLY FOR A ROTARY MACHINE

TECHNICAL FIELD

This invention relates to a stator assembly for an axial flow rotary machine which includes a device for selectively flowing air from a working medium flowpath of the machine. While the invention was conceived in the field of axial flow, gas turbine engines for bleeding air at a point between two compressor rotor assemblies, it has application to other devices in related fields.

BACKGROUND OF THE INVENTION

Axial flow gas turbine engines include a compression section, a combustion section and a turbine section. A flowpath for working medium gases extends through these sections of the engine. During operation, the gases are pressurized in the compression section and fuel is added in the combustion section. The fuel is burned to add energy to the pressurized gases. The hot, pressurized gases are expanded through the turbine section to provide the work of compression and hot, high pressure gases for subsequent use.

U.S. Pat. No. 3,898,799 issued to Pollert et al entitled "Device for Bleeding Off Compressor Air in Turbine Jet Engine" is an example of such a gas turbine engine. In Pollert, the compression section of the engine is provided with two independent mechanical compressors. During transient operating conditions, one compressor can provide more flow than can be accommodated by the second compressor. Accordingly, the compression section is provided with a plurality of passages extending about the working medium flowpath to allow a portion of the air to escape from the compression section. In particular, the engine has an inner ring that is provided with a plurality of openings. Each opening is covered or uncovered by an axially translating valve ring having radially extending seals. These seals extend radially between seal surfaces, as does a piston ring, between the valve ring and the circumferentially extending member having the openings. The valve ring is moved from an opened to a closed position by actuating means and includes guide rollers in one ring and guide slots in the other ring.

In other constructions, such as are found in some modern gas turbine engines, the engine is provided with circumferentially extending resilient seal members which extend axially between an axially translating valve ring and a seal surface. The valve ring is urged by simple actuating means from an open position to a closed position to axially compress the resilient seal members on either side of the openings to provide a gas tight seal.

As will be realized, the loss of working medium gases through the openings under steady state conditions when the compressors are operating at their design point will cause a decrease in the efficiency of the engine. Accordingly it is desirable to insure that flow does not occur through these openings under conditions which do not require the diversion of flow from the flowpath.

The above art notwithstanding, scientists and engineers working under the direction of Applicant's assignee have sought to decrease leakage through such seals by improving the sealing effectiveness of the seals and decreasing the effect that distortion resulting from operative load has on seal components.

DISCLOSURE OF INVENTION

According to the present invention, a stator structure, such as a compressor bleed valve, for flowing air from a working medium flowpath employs an annular valve ring extending circumferentially with respect to a plurality of radially extending holes, the valve ring being movable between an open and a closed position and being guided by a slot and guide pin combination for urging the valve ring axially against resilient sealing members, the slots being contoured to provide a mechanical advantage as the axial compressive force is applied to the resilient sealing members.

In one detailed embodiment, a resilient seal member extends between the guide pin member and adjacent stator structure to damp vibrations in the valve ring.

The primary feature of the present invention is an orifice ring extending circumferentially about the axis of the engine. Another feature is a valve having a valve ring which is concentrically disposed with respect to the orifice ring. The valve ring is movable between an open position and a closed position. The ring is guided by a slot and pin (cam follower) configuration, the slot having a preselected contour as the ring compresses the resilient seal members such that an inclined plane effect is provided during compression. In one embodiment, a feature is a bushing which engages the cam follower and the adjacent stator structure as the valve ring is moved to the open position. In one detailed embodiment, a radially extending flange on the valve ring slidably engages the orifice ring to position the ring in the radial direction as it moves between the open and closed positions. The actuating mechanism is a bellcrank which is equally spaced with a plurality of cam followers and slots about the circumference of the valve ring to more uniformly apply the axial force to the valve ring and the resilient sealing member.

A primary advantage of the present invention is the sealing effectiveness which results from the increased positive axial compression of the resilient seal members by the valve ring and the decreased effect of tolerances which results from the mechanical advantage of the design during compression of the compressible seal members. Still another advantage is the sealing effectiveness which results from decreasing the relaxation of seal compression during operative conditions by using a one-piece orifice ring engaged by the valve ring which receives the reacted loads from both the valve ring and the resilient seal members. Another advantage is the sealing effectiveness which results from radially positioning the valve ring with respect to the orifice ring with the pin and slot combination and a radially extending flange which centers the valve ring with respect to the orifice ring. An advantage is the sealing effectiveness which results from tying the orifice ring and the valve ring together with the cam follower and the radially extending flange on the valve ring so that the valve ring follows out of plane distortions of the resilient seal members mounted on the orifice ring. Finally, an advantage in one embodiment is decreased wear which results from the resilient damping member which extends between the valve ring and the adjacent structure when the valve is in the open position.

The foregoing features and advantages of the present invention will become more apparent in light of the following detailed description of the best mode for carrying out the invention and in the accompanying drawings.

BRIEF DESCRIPTION OF THE DRAWINGS

FIG. 2 is an enlarged cross-sectional view of a portion of the engine shown in FIG. 1.

FIG. 3 is a plan view taken along the lines 3—3 of FIG. 2.

DESCRIPTION OF THE PREFERRED EMBODIMENT

Figure 1:
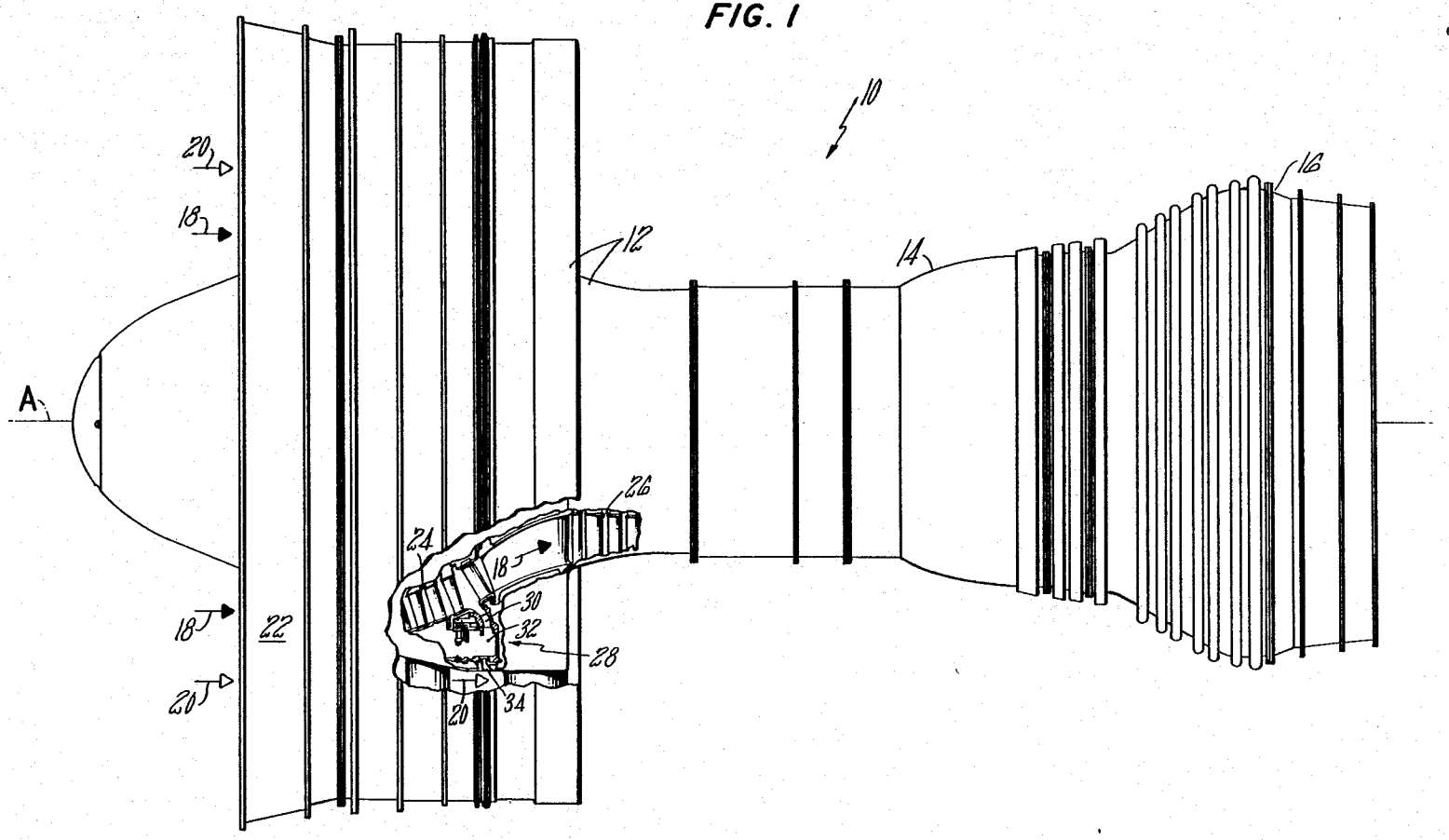
FIG. 1 is a side elevation view of a gas turbine engine with the exterior of the engine broken away to show a portion of the interior of the engine.

FIG. 1 is a side elevation view of an axial flow, gas turbine engine 10 of the turbofan type having an axis A. The exterior of the engine is broken away to show a portion of the interior of the engine.

The engine 10 has an has annular compression section 12, a combustion section 14 and a turbine section 16, which are disposed about the axis A. A primary flowpath 18 for working medium gases extends circumferentially about the axis of the engine and rearwardly through the sections of the engine. A secondary flowpath 20 for working medium gases, commonly called a bypass flowpath, is radially outwardly from the first flowpath and extends rearwardly through the outermost portion of the compression section of the engine.

The compression section includes a fan 22, a first compressor 24 and a second compressor 26 spaced rearwardly from the first compressor. The first compressor is commonly called the low pressure compressor and the second compressor is commonly called the high pressure compressor. These compressors are designed to operate at different speeds.

The engine has a compressor bleed system 28 which includes a plurality of passages 30, a chamber 32 and a second plurality of passages 34 which place the primary flowpath 18 for working medium gases in flow communication with the secondary flowpath 20.

FIG. 2 is an enlarged view of a portion of the engine shown in FIG. 1 showing in further detail the compressor bleed system 28. An inner case 36 has a flowpath wall 38 which outwardly bounds the primary flowpath 18. The inner case also has a second (outer) flowpath wall 40 which inwardly bounds the secondary flowpath 20. The outer flowpath wall is spaced radially from the inner flowpath wall leaving the annular chamber 32 therebetween. An orifice ring 42 extends circumferentially to bound a portion of the chamber. Each passage 30 extends from the primary flowpath 18 to the chamber 32 through the inner flowpath wall and through the orifice ring.

The orifice ring 42 is of a one-piece construction. The orifice ring has a pair of seal surfaces 44, 46 extending circumferentially about the ring. The seal surfaces are oriented in the axial direction and face upstream. The seal surfaces are spaced axially defining a seal region 48 therebetween. An outwardly facing, cylindrical surface 49 extends axially between the seal surfaces. The seal surfaces are located such that each passage through the one-piece ring has an opening 50 in flow communication with the seal region.

The orifice ring has an axially extending flange 52 having an outwardly facing surface 54 and a plurality of slots, as represented by the slot 56, which adapts the orifice ring to receive a plurality of cam followers 76. A pair of compressible seal members 58, 60 are spaced axially and bound the seal region. Each compressible seal member is adapted to engage an associated seal surface 40, 44 on the orifice ring. The compressible seal members may be made of any material that is compatible with the environment and which resiliently deforms upon the application of pressure. This particular compressible seal member is formed of AMS (Aerospace Material Specification) 3347, a silicone rubber.

The compressor bleed system includes a valve 62 having a valve ring 64. The valve ring has a sleeve 6 outwardly of the passageways 30 in the orifice ring. The sleeve is concentrically disposed with respect to the cylindrical surface 49 of the orifice ring. The valve is movable to a first, open position (shown in full) and to a second, closed position (shown in phantom). The valve ring has a radially extending flange 68 which adapts the ring to slidably engage in the axial direction the outwardly facing surface 54 of the flange 52. In addition, the valve ring has an inwardly facing surface 70 which is adapted to slidably engage the corresponding outwardly facing cylindrical surface 49 on the orifice ring. The valve ring has two axially facing surfaces 72, 74 which are oriented in the downstream direction and which are spaced axially by a distance which permits each surface to engage an associated compressible seal member 58, 60. The seal members are adopted by a circumferentially extending projection, such as **58*a* or 60*a***, to engage the valve ring.

The compressor bleed system 28 includes at least one cam follower 76 which is attached to the valve ring by a bracket 78. In the particular embodiment shown, a plurality of cam followers, as represented by the cam follower 76, are disposed at equally spaced locations about the circumference of the ring. Each cam follower has a resilient bushing 80 formed of AMS (Aerospace Material Specification) 3349, a silicone rubber, which engages a portion of the adjacent stator structure as the valve is moved to the open position. In this case, the adjacent stator structure is a flange 82 extending from the outer wall of the primary flowpath. The cam follower includes a pin 84 disposed in the slot 56. The cam follower has a bearing roller assembly 86 of the type commercially available from the Kamatics Corporation, a Kaman Company, P.O. Box 3, Bloomfield, CT 06002 which adapts the pin to engage the sides of the slot. The bearing liner for the bearing race is made of KARON material, a material applied by the Kamatics Corporation during manufacture of the roller assembly.

FIG. 3 is a plan view of a portion of the circumferentially extending orifice ring 42 taken along the lines 3—3 of FIG. 2 showing the roller 86 of the cam follower 76 disposed in the slot 56 in the orifice ring. The slot extends axially and circumferentially in the flange toward the seal region and has a pre-selected contour which follows the mean line shown in phantom. The contour is selected such that the amount of circumferential travel of the cam follower for a given amount of axial travel increases as the valve ring moves to the closed position. Thus, with the y direction extending in the axial direction and the x direction extending as a tangent in the circumferential direction, the slope dy/dx decreases as the valve ring moves towards the closed position providing a mechanical advantage during compression of the compressible seal members. In addition, if desired, the slope may be contoured such that it is negative at closure to provide a positive locking feature.

Figure 4:
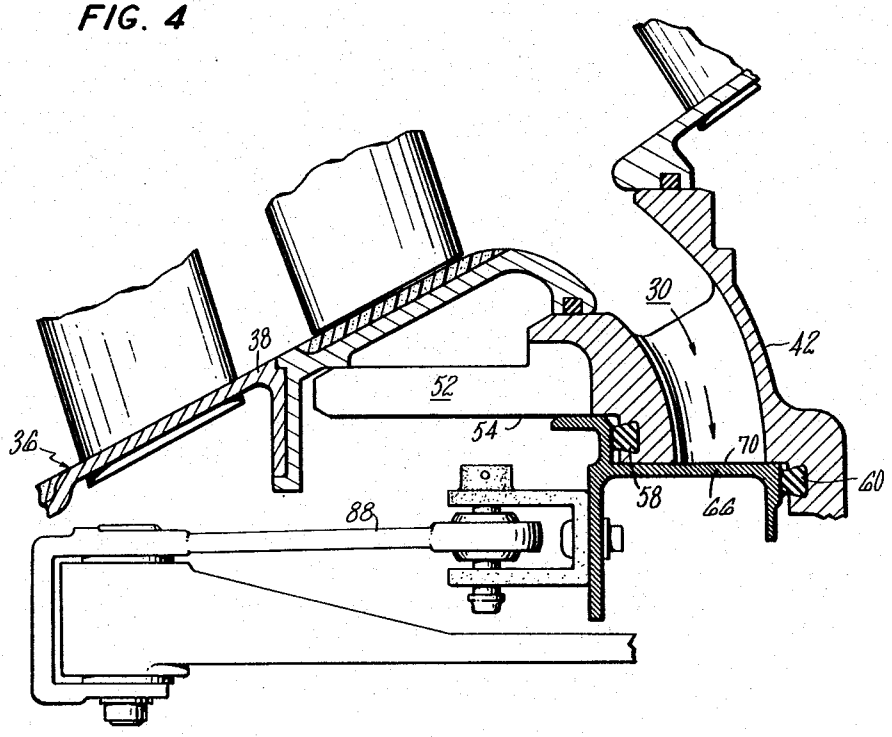
FIG. 4 is a cross-sectional view of another portion of the engine showing an actuating means and a portion of the structure which is shown in FIG. 2.

FIG. 4 shows a bellcrank linkage 88 (which alternatively might be a lever arrangement) disposed at one of the equally spaced locations around the circumference of the orifice ring 42 in place of a single cam follower 76. The bellcrank linkage acts as a drive means to urge the valve ring from the open position to the closed position and from the closed position to the open position in response to rotation of the drive means, primarily through circumferential movement of the linkage. The path of the end of the bellcrank that is attached to the valve ring guides the valve ring in substantially the same path as that resulting from following the cam followers situated at the other equally spaced locations around the circumference valve. The bellcrank does not guide the ring with the same exactitude as do the cam follower and slot arrangements.

During operation of the gas turbine engine shown in FIG. 1, working medium gases are flowed along the primary and secondary flowpaths 18, 20. As the gases pass through the first and second compressors 24, 26, and as the operating speeds of the individual compressors are adjusted during transient conditions, it may be desirable to divert some of the flow from the primary flowpath 18 to the secondary flowpath 20. The valve ring 64 is moved from the closed position shown by the phantom lines in FIG. 2 to the open position shown by the solid lines. The valve ring is guided positively in a spiral motion by the cam followers 76 each of which moves in an associated slot 56 in the orifice ring 42. As the cam followers move to the open position, the resilient bushing 80 is compressed providing a means to damp vibrations and block the cam follower from wearing the slot.

Under other operating conditions of the engine, the bellcrank linkage 88 pulls the cam followers 76 in the circumferential direction urging the valve ring 64 to the closed position to prevent the leakage of working medium gases from the primary flowpath 18 and into the secondary flowpath 20. As the valve ring moves to the closed position, the contour of the slot 56 provides a mechanical advantage similar to that encountered with an inclined plane to insure that tight-sealing contact exists between the valve ring, the orifice ring 42 and the compressible seal members 58, 60 disposed between the valve ring and the orifice ring. Thus, the amount of circumferential travel of the cam follower increases for a given amount of axial travel as the valve closes. The compressible seal members, the orifice ring and the valve ring together provide a satisfactory seal under all operating conditions of the engine.

As the valve ring moves between the open and closed positions, the radially facing surfaces 68, 70 on the valve ring and on the orifice ring 50, 54 act to center the valve ring about the orifice ring. Further centering is provided by the cam follower which provides a spline type connection, as where a plurality of cam followers are spaced around the circumference of the valve ring and the orifice ring, and, the cam follower are attached to one ring and engage the other ring.

In addition, the valve ring is tied to the orifice ring by both the cam followers and the radially extending flange 68, and the axially extending surfaces 49, 70 so that the valve ring will follow out of plane distortions of the seal members to provide satisfactory sealing contact under all operating conditions of the engine.

As shown in FIG. 2 by the reaction forces $F_1$, $F_2$ and $F_3$, the seal compression loads in the closed position are all reacted in the orifice ring area of the static structure. This includes $F_1$ which is the cam follower load on the support structure in reaction to the seal loads, and $F_2$ and $F_3$ which are seal loads on the support structure. This has the advantage of reducing any turning moments which result from the coupling of the forces and reduces relaxation of the seal compression during operative conditions as compared to structures in which such loads are more widely separated through use of a several piece construction for reacting the loads.

As will be realized one or both of the compressible seal members might be mounted on the valve ring rather than being retained by the orifice ring as shown in FIG. 2.

Although the invention has been shown and described with respect to detailed embodiments thereof, it should be understood by those skilled in the art that various changes in form and detail thereof may be made without departing from the spirit and the scope of the claimed invention.

We claim:

1. A stator assembly for an axial flow rotary machine having an axis, and annular flowpath for working medium gases extending about the axis, the machine having an axial direction and a circumferential direction with respect to the axis, which comprises:

an orifice ring which extends circumferentially with respect to the working medium flowpath and which has a plurality of passages extending therethrough in flow communication with the working medium flowpath;

a valve which includes a valve ring concentrically disposed with respect to the orifice ring which is movable to an open position and to a closed position, the valve ring having a pair of sealing surfaces spaced axially one from the other and having an inwardly facing surface extending between the sealing surfaces;

a pair of deformable resilient, sealing members extending circumferentially with respect to the valve ring and the orifice ring, the sealing members defining a seal region into which the passages extend; and, means for urging the valve ring in the circumferential and axial direction to move the valve ring from the open position to the closed position;

wherein the valve ring is adapted to urge the seal members axially against the orifice ring to form a seal which blocks the flow of working medium gases through said passages; wherein the stator assembly further includes a plurality of slots disposed about the stator assembly, each slot extending an amount in the circumferential direction for a given amount of axial distance, the circumferential amount for a given distance having one magnitude over one portion of the slot and a different magnitude over another portion of the slot; and, wherein the valve ring engages each slot such that motion of the valve ring is guided by the slots and the slots are contoured such that the amount of circumferential travel of the valve ring for a given amount of axial travel increases as the valve ring moves to the closed position.

2. The stator assembly of claim 1 wherein the slots are formed in the orifice ring.

3. The stator assembly of claim 2 wherein the valve ring is disposed outwardly of the orifice ring.

4. The stator assembly of claim 3 wherein the machine is a turbofan gas turbine engine having an annular primary flowpath and an annular secondary flowpath and the working medium gases are flowed from the primary flowpath to the secondary flowpath through said passages.

5. A stator assembly for an axial flow rotary machine having an axis, a compressor section disposed about the axis, an annular flowpath for working medium gases which extends through the compressor section about the axis and a plurality of passages for selectively flowing air from the working medium flowpath, the machine having an axial direction and a circumferential direction with respect to the axis, which comprises:

a one-piece orifice ring extending circumferentially about the axis of the machine having a plurality of passages extending therethrough, a pair of seal surfaces facing axially which extend circumferentially about the orifice ring, which are spaced axially defining a seal region therebetween, and which are located such that each of said passages has an opening in flow communication with the seal region, and, an axially extending flange having an outwardly facing surface and a slot extending axially and circumferentially in the flange toward the seal region, the slot having a preselected contour;

a pair of compressible seal members which are spaced axially and which are each adapted to engage an associated seal surface on the orifice ring and on a valve ring;

a valve which includes a valve ring outwardly of the orifice ring which is movable to an open position and to a closed position having a radially extending flange which adapts the ring to slidably engage in the axial direction the outwardly facing surface on the flange of the orifice ring, two seal surfaces facing axially which are spaced axially and which each adapt the valve ring to engage one of the compressible seal members, a cam follower attached to the valve ring which is slidably disposed in said slot to guide the valve ring as the valve moves between the open position and the closed position, and a bushing of resilient material at each cam follower in the open position, the bushing being adapted to engage the cam follower and an adjacent portion of the rotary machine as the cam follower is moved to the open position;

means for exerting a circumferential force on the valve ring to urge the valve ring from the open position to the closed position;

wherein the seal surfaces of the valve ring each axially urge the associated compressible seal member against the orifice ring as the valve ring moves to the closed position to block the flow of working medium gases from the working medium flowpath, wherein the slot is contoured such that the amount of circumferential travel of the cam follower for a given amount of axial travel increases as the valve ring moves to the closed position to provide a mechanical advantage during compression of the compressible seal members by the valve ring, wherein the radially extending flange on the valve ring centers the valve ring about the orifice ring, and wherein the valve ring is tied to the orifice ring by the cam follower and the radially extending flange so that the valve ring follows out of plane distortions of the seal members and wherein the valve ring loads and the seal member loads are reacted into the same one piece structure to reduce relaxation of the seal compression during operative conditions.

6. The stator assembly of claim 5 wherein one compressible seal member is attached to the orifice ring and the other compressible seal member is attached to the valve ring.

7. The stator assembly of claim 5 wherein the compressible seal members are attached to the valve ring.

8. The stator assembly of claim 5 wherein the compressible seal members are attached to the orifice ring.

9. The stator assembly of claim 5 wherein the resilient bushing is attached to the cam follower.

10. The stator assembly of claim 5 and wherein the axial direction is denoted by the variable y, the circumferential direction by the variable x and both variables are positive in the directions the cam follower follows as it moves toward the closed position and wherein the slope of the slot (dy/dx) decreases toward the closed position.

11. The stator structure of claim 5 wherein the means for urging the valve ring toward the closed position is a bellcrank which is equally spaced with the cam followers about the circumference of the orifice ring.

12. The stator structure of claim 5 wherein the orifice ring has a cylindrical surface thereon which extends axially in the seal region between the seal surfaces on the orifice ring, the valve ring has a cylindrical sleeve which extends between the seal surfaces of the valve ring and which is adapted to slidably engage the cylindrical surface on the orifice ring which extends axially in the seal region.

* * * * *